United States Patent [19]

Michalski

[11] 3,995,129

[45] Nov. 30, 1976

[54] KEY SWITCH COMPONENT

[75] Inventor: Dieter Michalski, Berlin, Germany

[73] Assignee: Rudolf Schadow GmbH, Berlin, Germany

[22] Filed: Mar. 14, 1975

[21] Appl. No.: 558,262

[30] Foreign Application Priority Data

Mar. 18, 1974 Germany ..... 2413002

[52] U.S. Cl. ..... 200/67 B

[51] Int. Cl.[2] ..... H01H 13/28

[58] Field of Search ..... 200/67 B, 67 R, 315, 200/332

[56] References Cited

UNITED STATES PATENTS

| | | | |
|---|---|---|---|
| 2,729,714 | 1/1956 | Broch | 200/67 B |
| 3,571,541 | 3/1971 | Bedocs | 200/67 B |
| 3,743,805 | 7/1973 | Guinan | 200/315 |
| 3,914,570 | 10/1975 | Lockard | 200/332 |

*Primary Examiner*—David Smith, Jr.
*Attorney, Agent, or Firm*—James B. Raden; William J. Michals

[57] ABSTRACT

A key switch component for mounting on printed circuit boards of preferably digital circuits, comprising a housing and one or more fixed contacts in connection with a pivotally mounted contact tongue which is held by a tension spring in a first switch position and is tipped into a second switch position by the pressure of a pivotally mounted actuating key on the spring.

8 Claims, 3 Drawing Figures

KEY SWITCH COMPONENT

The present invention relates to a key switch component for mounting on printed circuit boards of preferably digital circuits, comprising a plastic housing and one or more fixed contacts in connection with a pivotally mounted contact tongue which is held by a tension spring in a first switch position and is tipped into a second switch position by the pressure of a pivotally mounted actuating key on the spring.

Key switches are known which comprise pivotally mounted plastic keys which are mounted against the force of a separate return spring and held by a stop in their off position. The difficulty with these switches lies in the technical forming of the bearings, in particular when the mounting is to be free of play.

The invention is based on the problem of providing a switch which is universally suitable for digital circuit technique and which has two defined switch positions, consists of a small number of parts and may be easily made and assembled.

According to the invention this problem is solved in that the tension spring simultaneously loads the pivot bearing of the key and produces the key return force. A contact tongue moving between two switch positions may be provided and is biased by a tension spring whose abutment simultaneously forms a spring-loaded pivot bearing for an actuating key so that the tension spring provides in one direction the biasing force for the tipping moment of the contact tongue and furthermore defines the contact pressure and in the other direction resiliently loads the key pivot bearing and provides the return force for the key.

The multiple function of the tension spring, which can be mounted in the switch housing by a simple constructional step without biasing, has the advantage that only a few parts are required and the resiliently loaded key pivot bearing is completely free from play. The effects of any wear which occurs are eliminated by the spring force.

In a further development of the idea underlying the invention the contact tongue consists of an M-shaped bent wire member whose lateral legs are bent outwardly or inwardly and drawn by the tension spring engaging in the centre of the M onto the contact bearings forming the current feed. The two-point support which results guarantees high contact reliability.

The two contact bearings may be amplified by a current bridge so that two terminal poles connected in the switch housing result. This simple step permits junction-free conductor routes in printed circuits when a plurality of key switches are to be disposed in series and current feeds interconnected transversely.

The bearing bores at the legs of the actuating key are advantageously made open on one side and provided with an inclined portion so that on assembly they can engage the sprung pins of the pivot bearing and in this manner arrest the key.

Furthermore, a luminous diode (LED) may be disposed in the switch. An example of the embodiment of the invention will be described hereinafter.

Figure 1:
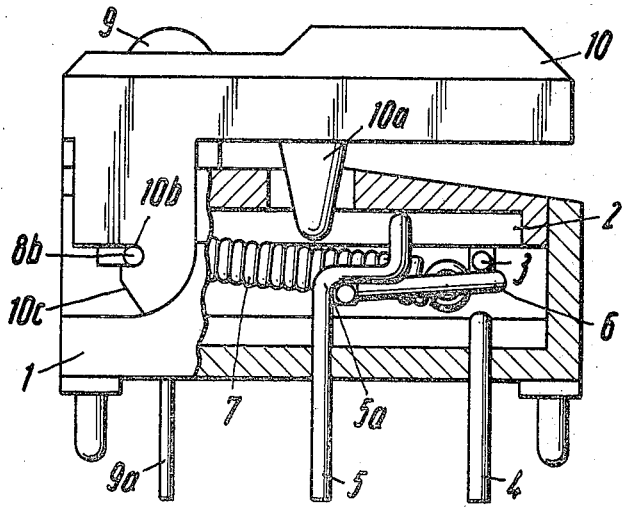
FIG. 1 is a side elevation of the key switch in non-depressed key position (partially in section).

In the example of embodiment illustrated in FIG. 1 a key switch consists of three plastic moulded portions. The housing lower portion 1 is so shaped that a perpendicularly bent upper fixed contact 3 on the one side of the contact tongue 6 and a lower fixed contact 4 on the opposite side of the contact tongue as well as a contact bearing 5 may be simply inserted, bordered by the housing upper portion 2 and simultaneously secured. A luminous diode 9 with terminal wires 9a may be additionally incorporated in the same manner. The fixed contacts 3, 4, the contact bearing 5, and a contact tongue 6 are preferably made in the example illustrated from hard-gilded wires.

Figure 3:
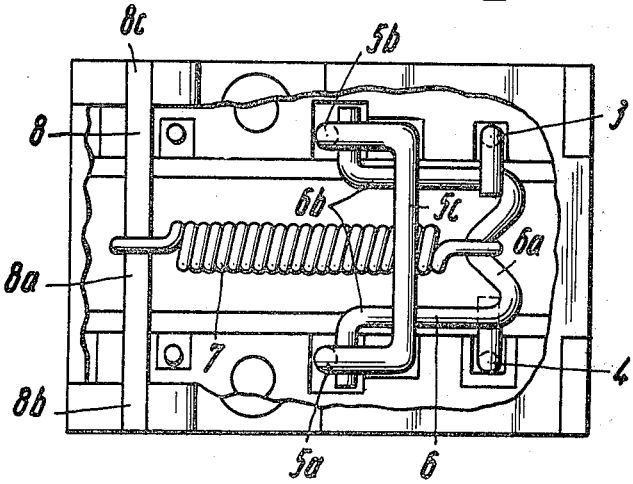
FIG. 3 is a plan view of the switch housing (upper part opened).

In FIG. 3 the legs of the M-shaped contact tongue 6 are bent at right angles and are pulled by a tensioned spring 7 engaging the centre of the M **6*a* onto the contact bearing 5 forming the current feed. The two terminal poles 5*a*, 5*b* of the contact bearing are directly connected by a current bridge 5*c*. At the same time, at the point 8*a* the tension spring 7 exerts a force on the pivot bearing 8** which in the example illustrated consists of a steel pin.

The bearing bores **10*b* in the FIG. 1 at the legs of the actuating key 10 are opened on one side and provided with an inclined portion 10*c*. On assembly the key engages into the resilient pivot bearing 8*b*, 10*b*** and is automatically arrested.

Figure 2:
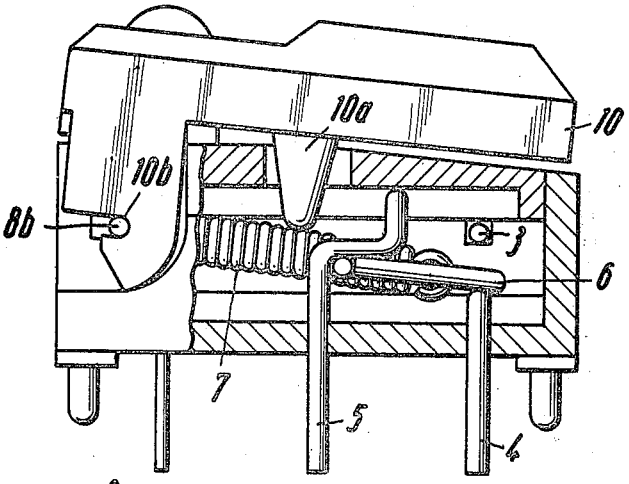
FIG. 2 is a side elevation of the key switch in the depressed key position (partially in section).

On actuation of the key 10 in FIG. 2 the switch lever **10*a* presses the tension spring 7 and tips the pivotally mounted contact tongue 6 from its first to its second switch position. Simultaneously, the pivot bearing 8*b*, 10*b* is tensioned and produces the return force for the actuating key 10.**

I claim:

1. A key switch for use in an electric circuit, comprising:

a housing; a key; a key pivot in said housing on which said key is pivotally mounted;

a first fixed contact fixed at one position in said housing; a second fixed contact fixed at a second position in said housing spaced from said one position and defining a space between said fixed contacts;

a movable contact tongue positioned in said space between said fixed contacts and extending away from said space generally toward said key pivot; said contact tongue having a pivot portion at the end thereof away from said space;

a pivot bearing fixed in said housing against which said movable contact tongue pivot portion pivotally bears;

said movable contact tongue being pivotable about said pivot portion in a first direction toward said first contact and being pivotable in the opposite second direction toward said second contact;

a tension spring connected to said movable contact tongue at a location between said pivot portion and said space; said tension spring also being connected to said key pivot, so as to draw said movable contact tongue pivot portion against said pivot bearing; the position of said pivot bearing and of said key pivot and of said connection between said spring and said movable contact tongue being related such that said movable contact tongue is normally biased by said spring in said first direction against said first contact;

said key being pivotable about said key pivot in said first and said second directions; said key including a spring engaging element positioned such that upon said key being pivoted in said second direction, said element engages and presses upon said spring in the direction toward said second contact and said movable contact tongue is pivoted in said second direction to engage said second contact.

2. The key switch of claim 1, wherein said housing includes a key receiving recess which opens to the outside of said housing in a direction facing away from said pivot bearing, and said key includes a leg engageable in said key receiving recess; said key receiving recess and said key leg being cooperatively so shaped as to enable said key to pivot with respect to said key receiving recess around said key pivot.

3. The key switch of claim 2, wherein said key leg has a pivot recess formed therein in which said key pivot is located.

4. The key switch of claim 3, wherein said pivot recess opens to the outside of said housing at a side of said key leg that generally faces away from said pivot bearing.

5. The key switch of claim 4, wherein said key leg has an extended section beyond said pivot recess; said extended section having an inclined edge which leads toward the opening into said pivot recess, thereby to guide said key pivot into said pivot recess upon movement of said key leg into said key receiving recess.

6. The key switch of claim 1, wherein said pivot bearing comprises an electrical connection such that said movable contact tongue is electrically and mechanically connected to said pivot bearing.

7. The key switch of claim 6, wherein said contact tongue is generally M-shaped, having a central portion and legs; said pivot bearing comprising two spaced apart elements, each positioned to be engaged by a said leg of said contact tongue; said tension spring being connected to said central portion of said M-shaped contact tongue.

8. The key switch of claim 6, wherein said pivot bearing comprises two spaced apart bearing elements; said movable contact tongue engaging both said bearing elements; a bridging element of said pivot bearing extending between the two said bearing elements, thereby defining an electric current bridge therebetween.

* * * * *